United States Patent [19]

Herzog et al.

[11] 4,280,301

[45] Jul. 28, 1981

[54] MATERIAL HANDLING SYSTEM AND METHOD

[75] Inventors: Donald E. Herzog; Larry Thomas, both of St. Louis, Mo.

[73] Assignee: St. Louis Conveyor Company, Inc., St. Louis, Mo.

[21] Appl. No.: 97,059

[22] Filed: Nov. 26, 1979

Related U.S. Application Data

[63] Continuation of Ser. No. 879,471, Feb. 21, 1978, abandoned.

[51] Int. Cl.[3] ..... B26B 1/00

[52] U.S. Cl. ..... 51/5 R; 51/318; 51/418; 51/426; 164/269; 198/346; 29/33 C

[58] Field of Search ..... 29/33 A, 33 C, 526.4, 29/527.6; 51/5 R, 5 A, 215 E, 417, 418, 426; 164/269; 198/346, 366

[56] References Cited

U.S. PATENT DOCUMENTS

| | | | |
|---|---|---|---|
| 677,691 | 7/1901 | Packer | 51/5 R |
| 1,628,317 | 5/1927 | Hoevel | 51/426 X |
| 2,229,492 | 1/1941 | Christensen | 164/269 X |
| 2,563,844 | 8/1951 | Johnston | 164/269 |
| 2,600,038 | 6/1952 | Whaley | 198/346 |

*Primary Examiner*—Gary L. Smith
*Attorney, Agent, or Firm*—Lionel L. Lucchesi

[57] ABSTRACT

A material handling system is provided having particular application in grey iron foundries. In general, the system provides a continuous flow of work from the time castings are removed from their molds until the castings are ready for shipping. In particular, the system includes an environmentally acceptable grinding room work station in the form of a totally enclosed work area. Means for feeding material into and from the work station include a first plurality of gravity feed input chutes operatively coupled to a conveyor system on the input side of the work station, and a second plurality of gravity feed output chutes leading to another area on the output side of the work station. The conveyor system is designed to carry the castings from shake-out to the enclosed work area. Scrap is separated from the molded parts prior to their entrance into the work area and rejected parts continue along past the gravity feed input chutes to an accumulation storage device.

11 Claims, 5 Drawing Figures

MATERIAL HANDLING SYSTEM AND METHOD

This is a continuation of application Ser. No. 879,471 filed Feb. 21, 1978, now abandoned.

BACKGROUND OF THE INVENTION

This invention relates to material handling systems, and in particular, to a material handling system finding application in the handling of cast iron parts in foundries. While the system is described with particular reference to its foundry application, those skilled in the art will recognize the wider applicability of the inventive principles disclosed hereinafter.

Material handling in most foundries today can be best described as archaic. In general, sand molds are loaded with the molten material to form the desired molded product. After the parts are cast at a molding station, they are allowed to cool to a set condition and then removed from the molds. The cast parts or casting thereafter require some period for further cooling, conventionally in the vicinity of two to four hours before they can be handled by other foundry personnel. After cooling, the castings are transported to a suitable storage area where they are backlogged before further processing takes place. Generally, it is more efficient to maintain the molding machinery in continuous or nearly continuous operation. However, to accomplish this objective, present day foundries must backlog the molded or cast parts if molding machinery efficiency is to remain high. Consequently, foundries not employing our invention require a considerable floor area for part storage after casting. From storage, the parts are processed as needed through a cleaning machine which is known in the art as a shot blast machine or apparatus. The shot blast machine cleans the casting by an abrasion process. After general cleaning in the shot blast machine, the castings are moved to another finishing station where metal flashes are clipped away. Grinding is performed as needed, and various other operations are performed on the castings to obtain the final product. Movement of the castings between the various work stations in the past has been accomplished by stacking the castings in tote carts which are moved by conventional forklift trucks.

The presence of forklift trucks, particularly when they are gasoline powered, adds considerable noise and air pollution to the foundry. The grinding, chipping, and flash removal, for example, accomplished on the castings likewise contribute heavily to pollution within the foundry. Recently, foundry pollution and environmental working conditions have been the target of stringent regulations, and the invention disclosed hereinafter enables a foundry to meet these new requirements by eliminating a number of deficiencies found in prior foundry operation. First, our invention eliminates the need for forklift trucks for moving material by utilizing a suitable conveyor system to transport the material between the various work stations. Second, it employs an environmentally safe, enclosed finishing room where casting finishing work can be accomplished without disturbing the environment of the remaining foundry area. Third, it eliminates unnecessary foundry personnel by mechanizing many of the operations previously accomplished by hand, or simplifies the operation so fewer workers are required to accomplish the task. Fourth, it eliminates the need for a separate casting storage area by using a portion of the conveyor system employed in part transport as a storage medium.

One of the objects of this invention is to provide a continuous flow pattern for handling material.

Another object of this invention is to provide a continuous flow pattern for handling material, which is adapted for carrying cast parts, the system including an accumulator for permitting cooling of the parts after casting.

Another object of this invention is to provide a system for handling material which includes an environmentally acceptable finishing room for conducting operations on the parts.

Another object of this invention is to provide a finishing room where parts are fed into and from the finishing room in an expeditious manner.

Another object of this invention is to provide a system for handling material in which rejected parts may be conveyed to a storage area for later rework.

Yet another object of this invention is to provide a material handling system which eliminates or reduces the need for a separate storage area for castings prior to finishing work being accomplished on the castings.

Other objects of this invention will be apparent to those skilled in the art in light of the following description and accompanying drawings.

SUMMARY OF THE INVENTION

In accordance with this invention, generally stated, a material handling system is provided for expeditiously moving material, and in particular, cast parts in foundries, from an initial station through complete processing of the parts in a continuous manner. The system incorporates an initial accumulation conveyor, the material transfer time of which permits cooling of the castings and coordination of the part casting process with the remaining finishing work conducted on the castings. The system also includes an environmentally acceptable finishing room having ingress and egress means for the castings in which the castings may be backlogged. The input side to the finishing room, in the embodiment illustrated, also includes a scrap return conveyor and a rejected part accumulator. Upon part output from the finishing room, additional finish work may be accomplished, or the parts may be made ready for shipment directly.

DESCRIPTION OF THE PREFERRED EMBODIMENT

Figure 1:
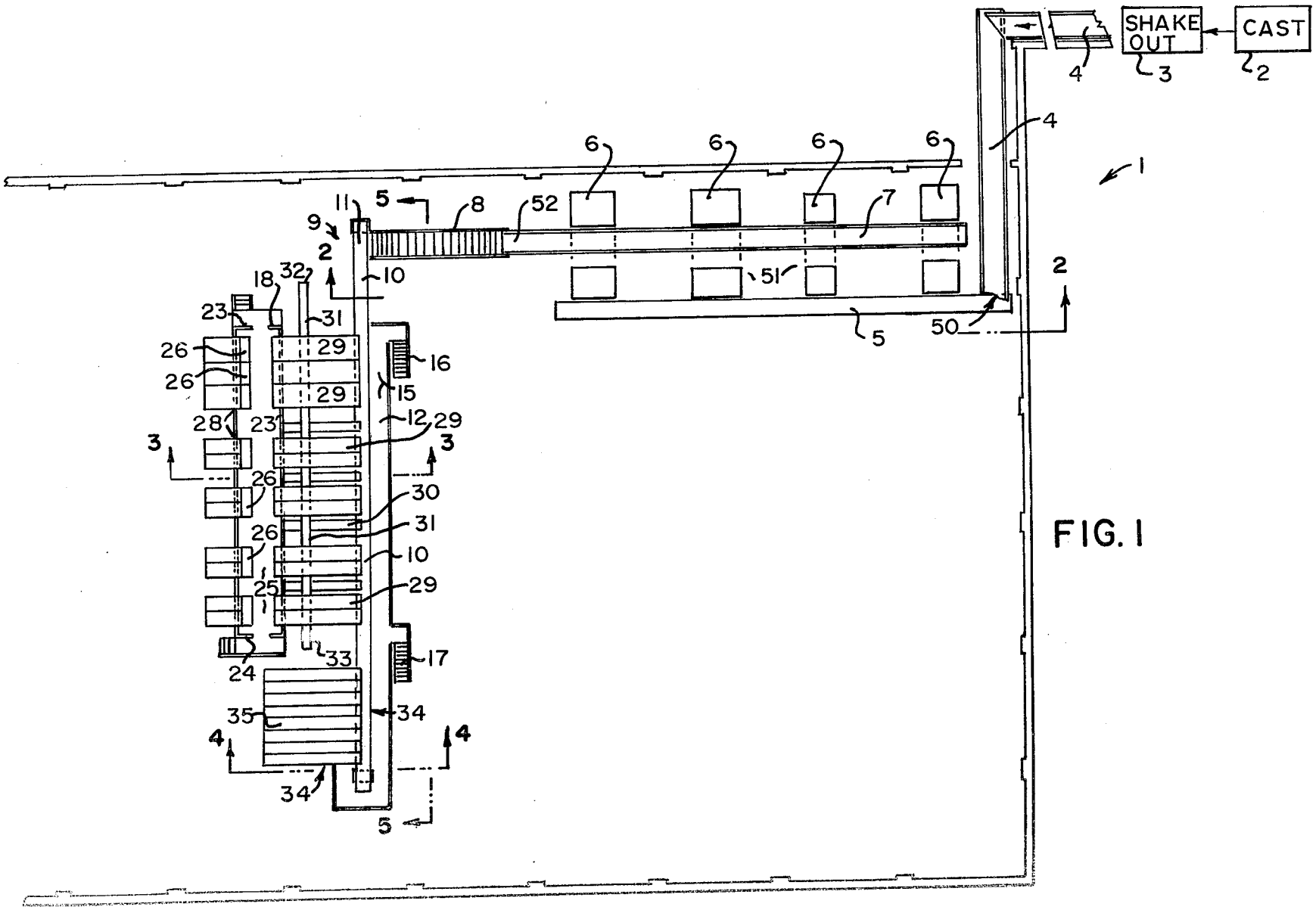
FIG. 1 is a top plan view of material handling system of this invention.

Referring now to FIG. 1, reference numeral 1 indicates one illustrative embodiment of material handling system of this invention. The system 1 is intended to be employed in steel or grey iron foundries producing cast parts from sand molds. In those foundries, the parts are cast in sand molds at a station 2. After solidifying, the castings and sand molds are transferred to a shake-out means 3. There, the parts are separated from the sand. Shake-out means 3 is conventional and generally is a vibrating device which "shakes" the parts to remove sand still clinging to the castings. As will be appreciated by those skilled in the art, at this point in the casting manufacturing process, the castings still are at an elevated temperature which precludes part handling by foundry personnel, and some arrangement for part cooling is required. Our invention eliminates the need for transferring the parts to storage for cooling by employing an accumulator conveyor 4.

The accumulator conveyor 4 may comprise any of a variety of conveyor devices compatible with the environment of the parts being carried thereby. The accumulator conveyor 4 is timed so that the transit time of the parts on the conveyor 4 enable the parts to cool sufficiently before further manual handling of the parts is required. The relatively slow transit time on the conveyor 4 also means that a considerable backlog of parts may be accumulated on the conveyor 4. Consequently, the conveyor 4 functions in a coordinating manner to equalize the production rates for casting manufacture and shake-out and later processing of the parts. It should be apparent that the layout design of the conveyor 4 may and will vary with the requirements imposed by particular foundry applications.

The accumulator conveyor 4 transfers the castings to a loading conveyor 5 in a conventional manner at a bend 50. The loading conveyor 5 transfers the casting to a shot blast work area 51. A plurality of shot blast means 6 are located at the area 51.

The various ones of the shot blast means 6 are conventional and generally are utilized in the foundry industry for further cleaning and processing of the castings. In general, the parts are tumble rolled with a suitable abrasive material, the abrasive material-casting interaction cleaning the casting before later processing. After passing through the shot blast means 6, the castings are deposited upon a unloading conveyor 7.

In the embodiment illustrated, the unloading conveyor 7 parallels the loading conveyor 5, but is positioned to receive the parts from the output side of the shot blast means 6. The unloading conveyor 7 transfers the parts to an apron conveyor 8 aligned with an output end 52 of the unloading conveyor 7. The apron conveyor 8 is arranged to connect the unloading conveyor 7 with a sorting conveyor 10 which is positioned at an elevated location 9. The sorting conveyor 10 includes, in the embodiment illustrated, a first section 11 which elevates the parts from the location 9 to a predetermined height above a sorting platform 12, as is best observed in FIG. 5.

Figure 3:
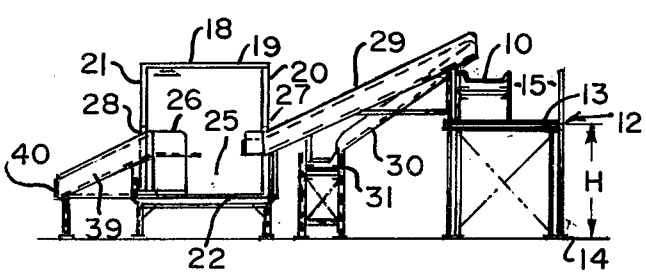
FIG. 3 is an elevational view taken along the line 3—3 of FIG. 1.

Referring now to FIG. 3, it is seen that the sorting platform 12 includes an elevated base 13 having a height H above a ground or base level 14. The platform 12 includes a work area 15 adjacent the conveyor 10. The work area 15 is provided to permit personnel to work along the conveyor 10, the personnel performing the sorting function described hereinafter. Toward that end, a number of entrances and exits to the work area 15 from and to the base level 14 are provided as indicated at 16 and 17 in FIG. 1.

A finishing room 18 is located adjacent to, but spaced from the conveyor 10. The finishing room includes a top 19, sides 20 and 21, a floor 22, and ends 23 and 24. As shown in the drawings, the finishing room 18 is intended to be a totally enclosed space. In general, the finishing room 18 structure provides a work area 25 between a plurality of work stations 26. The work stations 26 contain the necessary equipment for grinding, chipping or performing other operations on the castings.

The finishing room 18 has a plurality of inputs 27 for receiving castings, and a plurality of outputs 28 for permitting casting exit from the finishing room 18.

The inputs 27 to the finishing room 18 are operatively associated with the conveyor 10 through the use of a plurality of input chutes 29. The input chutes 29 have a first end positioned above the conveyor 10, and a lower, second end entering the finishing room 18 at the inputs 27. The chutes 29 are positioned so that workers may stand along the work area 15, inspect castings as they travel along the conveyor 10, perform minor operations on those castings, and feed them into the chutes 29 in a manner as to separate different part types (sorting). For example, flashes remaining on the castings after the shot blast operation may be removed and the parts visually inspected for defects. Acceptable parts are allowed to gravity feed down the chutes 29 to the finishing room 18. Scrap flashing and similar waste material is deposited in a scrap chute 30, best seen in FIG. 3.

Figure 5:
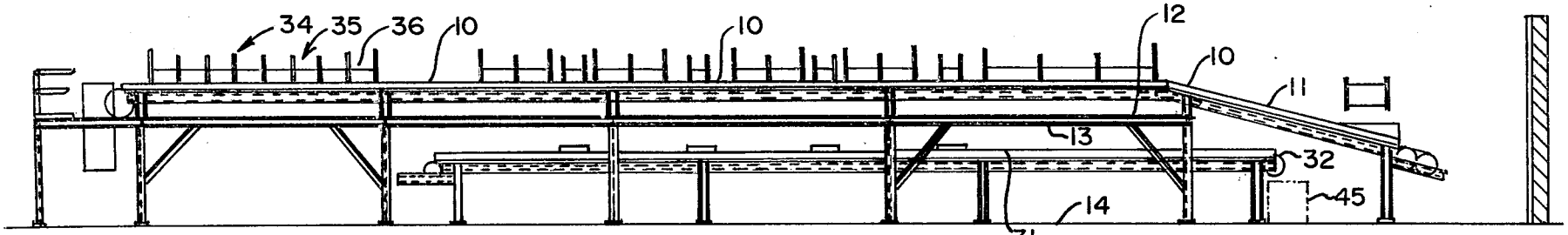
FIG. 5 is an elevational view taken along the line 5—5 of FIG. 1.
Figure 2:
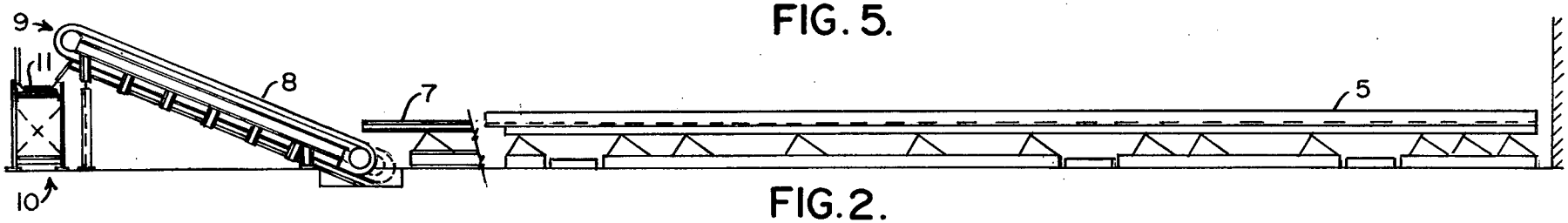
FIG. 2 is an elevational view taken along the line 2—2 of FIG. 1.

The scrap chute 30 leads waste material from the conveyor 10 to a scrap conveyor 31, from which the material is deposited in a suitable receptacle 45, shown in phantom lines in FIG. 5, at an end 32 of the conveyor 31.

Figure 4:
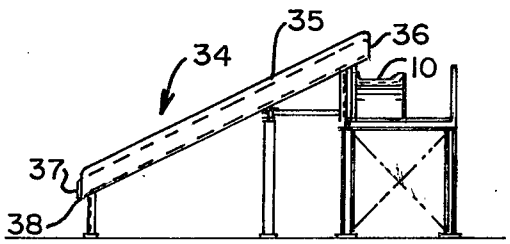
FIG. 4 is an elevational view taken along the line 4—4 of FIG. 1.

Parts found usable on visual inspection but requiring some rework operation are allowed to continue along the conveyor 10 to a collection station 34. In the embodiment illustrated, the collection station 34 includes a plurality of chutes 35 having an open end 36 and a fixed end 37. The end 36, as best seen in FIG. 4, is positioned above the conveyor 10, and parts requiring rework may be deposited by a worker into respective ones of the chutes 35. While the end 37 preferably is fixed, those skilled in the art will recognize that the end 37 may have any convenient closure means 38 blocking the end 37 so that the chutes 35 function as a storage device for the parts requiring reworking. The closure means 38 may be nothing more than a removable partition along the end 37 which blocks that end so that parts may build up against the partition. When discharge is desired, the partition is removed and the parts are deposited by gravity feed into a suitable container for transfer to another area. With the fixed end 37, parts are removed individually from the chutes 35, the chutes still providing the storage device function. Although the chutes 35, in the embodiment illustrated, are shown positioned above the conveyor 10, those skilled in the art will recognize that the chutes may be positioned at the same level of as the conveyor 10, and that suitable deflector may be incorporated with conveyor 10, chute 35 operation, so that the parts are deflected into successive ones of the chute automatically or semiautomatically by the positioning of the deflectors.

The input chutes 29 to the finishing room 18 also act as a storage means for parts entering the finishing room. That is to say, a backlog of parts may be kept in the chutes 29 until the operator at the work station 26 finishes operation on a particular casting. Upon completion of work on a particular casting, that casting is deposited into an output chute 39 or chutes associated with the outputs 28 of a particular station 26. The castings gravity feed from the finishing room 18 to a discharge opening 40 of the chutes 39. Again, the chutes 39 may function as a storage area for the castings, allowing a sufficient backlog of parts to build up for final processing. After passing through the finishing room 18, the parts are made ready for shipment. Although the end 40 preferably is fixed, some movably mounted arrangement may be employed, if desired.

Readying the parts for shipment often includes the performance of additional operations on the casting. For example, operations known in the a foundry art as final sanding may be performed, if desired.

The enclosed finishing room 18 enables a foundry employing the handling system of this invention to segregate the finishing room activity from remaining foundry operations, maintaining an environmentally safe condition in the remaining foundry area proper. The finishing room 18, being more compact than areas previously employed for this purpose, easily may be ventilated to maintain proper work conditions within the finishing room. In addition, the finishing room 18 may be acoustically segregated from the remaining foundry operation. Finally it is much easier to maintain overall cleaniness of the limited area of enclosed finishing room 18 than is possible with open areas previously employed for similar purposes.

It thus is apparent that the handling system of this invention provides for continuous casting processing from manufacture to shipment and employs a number of discrete storing areas which functions to coordinate overall timing for the continuous flow pattern of manufactured parts. Continuous casting flow is an important quality control feature of this invention in that defective castings from a particular mold, for example, can be detected early and corrective action taken. With prior art systems in which castings were stored after manufacture, the detection of a defective mold might occur long after a large backlog of defective parts were manufactured. With the continuous flow system, defective parts are detected much sooner. In addition, the continuous flow enables the foundry to operate with variable schedules in that casting manufacturing and finishing room personnel may have their work schedule adjusted to meet production demands in a much more flexible way than previously possible.

It thus is apparent that a material handling system meeting all the ends and objects herein set forth above has been provided and that various components of the handling system may be employed advantageously without relation to other parts or components described. Such component usage is contemplated by the appended claims.

Numerous variations, within the scope of the appended claims, will be apparent to those skilled in the art in light of the foregoing description and accompanying drawings. Thus, the layout of the material handling system essentially is a custom design for each particular foundry and is capable of various adaptations. One particular application may require conveyor use and design substantially different from those described. Likewise, the number of various ones of the input chutes, various components of the finishing room in the form of work stations, various ones of the output chutes, and various ones of the collection means 34 may be altered in other embodiments of this invention. The drawings illustrate particular structural components for positioning the elements of the material handling system of this invention. That construction form and design may vary. These variations are merely illustrative.

Having thus described the invention, what is claimed and desired to be secured by Letters Patent is:

1. A material handling system for gray iron foundries providing generally continuous work flow, comprising:

means for conveying and accumulating material at an elevated temperature along a single plane reference, said conveying and accumulating means permitting the material to cool to a temperature suitable for material handling by humans;

means for transferring said material to a first work station along said single plane reference;

means for conveying said material from said first work station to a first location elevated with respect to said single plane reference but environmentally a part thereof;

a second work station enclosure including a totally enclosed finishing room providing an area segregated from said first work station, and environmentally separate therefrom, said second work station having a plurality of inlets and a plurality of outlets operatively associated with the totally enclosed finishing room, said inlet and outlet plurality corresponding to a plurality of personnel work stations within said totally enclosed finishing room so that work on said material may be conducted within said finishing room, such work being conducted in the environmentally separate area provided by said finishing room, said inlets being arranged at an elevated location approximately equal to said elevated first location, and said outlets being at a lower elevation than said first elevated location;

means for conveying said material from said elevated first location and for connecting said elevated first location with said second work station enclosure including means for gravity feeding material from said last mentioned conveying means to said work station enclosure at said plurality of inlets;

means for gravity feeding material from said second work station enclosure at said plurality of outlets; and means at the end of said conveying and connecting means for collecting and accumulating any material not passing through said second work station enclosure wherein work enters said material handling system at said conveying and accumulating material means and leaves said material handling system at one of said second work station enclosure gravity feeding means and said last mentioned collecting and accumulating means.

2. The material handling system of claim 1 wherein said means for gravity feeding material to said second work station enclosure at said plurality of inlets comprises a plurality of gravity feed chutes connected to said means for conveying material from said elevated first location.

3. The material handling system of claim 2 wherein said means for gravity feeding material from said second work station enclosure comprises a plurality of gravity feed chutes operatively connected to the outlets of said finishing room.

4. The material handling system of claim 3 wherein said material collecting means comprises storage means, said storage means including a plurality of gravity feed chutes, said chutes being aligned with one another to accept material from said means for conveying material from said elevated first location, said chutes having a closed first end to permit material to build up in said chutes.

5. The material handling system of claim 4 adapted for use in a foundry, the material being handled by said system comprising a plurality of castings, further including at least one shot blast device for cleaning castings.

6. The material handling system of claim 5 wherein said first conveyor means has a length and speed to permit the cooling of said castings intransit as said castings move between a shakeout and said first work station.

7. The material handling system of claim 6 further characterized by scrap chutes operatively connected between the inlet gravity feed chutes of said finishing room and a scrap conveyor, and a scrap conveyor for conveying scrap from said scrap chutes to another location.

8. A material handling system for providing continuous flow of material, comprising:

accumulator conveyor means for conveying material from a manufacturing point to a first work station, said first work station having an input and an output along a single plane reference, said accumulator conveyor means receiving material at an elevated temperature unsuitable for human handling and discharging material at a temperature suitable for human handling;

second conveyor means at said first work station for conveying said material from the output of said first work station to a second work station at least supported along said single plane reference;

a second work station for receiving material from said second conveyor, said second work station comprising a finishing room enclosure for personnel performing operations on said material, said finishing room enclosure being totally enclosed and environmentally segregated from the area surrounding said first work station and said second work station, said finishing room enclosure having a plurality of inlets and a plurality of outlets operatively associated with the totally enclosed finishing room, said inlet and outlet plurality corresponding to a plurality of personnel work stations within said totally enclosed finishing room so that work on said material may be conducted within said finishing room, such work being conducted in the environmentally separate enclosure of said finishing room;

means for connecting the inlets of said finishing room with said second conveyor, so that material passes into said finishing room to said personnel work stations;

means for connecting the outlet of said finishing room with a third work area, so that material passes from said finishing room after any work on said material is conducted at said personnel work stations; and means at an end of said second conveyor for collecting and accumulating any material not passing through said finishing room.

9. The material handling system of claim 8 further characterized by collection means at the termination of said second conveyor for collecting material not passing through said finishing room from said second conveyor means.

10. The material handling system of claim 9 including means for collecting scrap, said scrap collecting means including a third conveyor, and scrap gravity feed means operatively connected between said third conveyor and said second conveyor.

11. A method of handling castings in a foundry, in a generally continuous flow pattern, comprising:

placing said castings at an elevated temperature unsuitable for human handling on an accumulator conveyor for accumulating a backlog of castings and cooling those castings to a temperature suitable for human handling as accumulated during transit on said conveyor; and processing said castings through a plurality of steps to obtain a finished product, at least one of said processing steps including processing by passing said castings through a totally enclosed finishing room, said totally enclosed finishing rooms providing work stations for a plurality of personnel performing operations on said castings environmentally segregated from other steps in said step plurality, the transfer of said parts in said process including ingress and egress at said finishing room on a continuous flow basis.

* * * * *